United States Patent [19]

De Fusco

[11] 4,244,527

[45] Jan. 13, 1981

[54] ELECTROSTATIC SPRAY GUN

[75] Inventor: Giuseppe De Fusco, St. Gall, Switzerland

[73] Assignee: Gema AG Apparatebau, St. Gall, Switzerland

[21] Appl. No.: 20,827

[22] Filed: Mar. 15, 1979

[30] Foreign Application Priority Data

Mar. 15, 1978 [CH] Switzerland ..... 2809789/78

[51] Int. Cl.[3] ..... B05B 5/02

[52] U.S. Cl. ..... 239/691; 200/81.9 R; 239/705

[58] Field of Search ..... 239/3, 690–708; 200/81.9 R, 81 H, 82 R, 82 C

[56] References Cited

U.S. PATENT DOCUMENTS

| | | | |
|---|---|---|---|
| 3,539,103 | 11/1970 | Marsh | 239/706 |
| 3,608,823 | 9/1971 | Buschor | 239/698 |
| 3,692,241 | 9/1972 | Walberg | 239/705 |

FOREIGN PATENT DOCUMENTS

| | | | |
|---|---|---|---|
| 1203970 | 10/1965 | Fed. Rep. of Germany | 200/81.9 R |

*Primary Examiner*—Andres Kashnikow
*Attorney, Agent, or Firm*—Werner W. Kleeman

[57] ABSTRACT

An electrostatic spray gun having an installed high-voltage generator, connected at its low-voltage side with an installed switch element for turning-on and turning-off the high-voltage generator. The spray gun further is provided with a flow channel for an atomizing gas, the flow channel being connected with a pressure line. A manually-operated closure valve is arranged in the flow channel. The switch element is structured as a flow-actuated or flow switch and is arranged in the flow channel and its movable contact is coupled with a closure element of a differential pressure valve arranged in the flow channel. In this way it is possible to only then turn-on the high-voltage generator when the atomizing gas flows in an undisturbed fashion through the flow channel. Disturbances in the flow of the atomizing gas, whether such be due to clogging of the nozzle at the spray gun, or due to a malfunction of the pressure source of the atomizing gas, thus automatically turn-off the high-voltage generator.

6 Claims, 2 Drawing Figures

ELECTROSTATIC SPRAY GUN

BACKGROUND OF THE INVENTION

The present invention relates to a new and improved construction of an electrostatic spray gun, sometimes also referred to in the art as an electrostatic powder coating gun.

The spray gun of the invention is of the type comprising an installed high-voltage generator and an installed switch means for turning-on and turning-off the high-voltage generator at its low-voltage side. Further, there is provided a flow channel for an atomizing gas, the flow channel being connected to a pressure line and within such flow channel there is arranged a manually-actuatable closure valve.

Such type spray gun is known to the art, for instance from Swiss Pat. No. 496,481. One of the advantages of such spray gun resides in the fact that by virtue of incorporating the high-voltage generator within the spray gun itself, it is possible to supply the high-voltage generator with electric energy at a low voltage or potential, i.e., by means of conductors or lines without the need for complicated insulation. With the heretofore known spray guns the switch or switch means constitutes a microswitch which can be mechanically actuated by a gun trigger bracket. As a result, the high-voltage generator remains turned-on as long as the trigger bracket is pressed, even then when a disturbance arises in the flow of the atomizing gas, whether such be because of failure of the pressure source delivering the atomizing gas or clogging of the atomizing nozzle.

This is associated with certain drawbacks, for instance also for the operation of the spray gun, since in the presence of a disturbed gas flow there can form weakly conductive bridges at the region of the atomizing or spray nozzle, i.e., at that location where there are arranged the charging electrodes. These weakly conducting bridges impair the charging and transport field for the atomized particles of the coating material, also after there has been eliminated the disturbance in the flow of the atomizing gas.

SUMMARY OF THE INVENTION

Hence, with the foregoing in mind it is a primary object of the present invention to provide a new and improved construction of electrostatic spray gun which is not associated with the aforementioned drawbacks and limitations of the prior art proposals.

Another and more specific object of the present invention is directed to the provision of a new and improved construction of spray gun of the previously mentioned type, wherein the high-voltage generator can only then be turned-on when the atomizing or spray gas flows without any disturbance through the spray gun.

Now in order to implement these and still further objects of the invention, which will become more readily apparent as the description proceeds, the proposed spray gun of the present development and of the previously mentioned type, is manifested by the features that the switch or switch means, constructed as a flow switch, is arranged in the flow channel and has a movable contact which is coupled with the closure element of a differential pressure valve which is connected into the flow channel.

Now it is already known to the art, from British Pat. No. 1,237,064, in the case of an electrostatic coating installation working with a spray gun, to design the switch which turns-on and turns-off the high-voltage generator at the low-voltage side as a diaphragm switch which is activated by the flow of the atomizing or spray gas. However, with this prior art construction the high-voltage generator is separate from the spray gun and arranged in a supply unit for the atomizing gas. With this installation it is thus necessary to supply the spray gun with the high-voltage by means of a number of more or less long lines or conductors provided with complicated insulation, and this is equally so for the pressurized atomizing gas. Since the flow switch is erected at a location removed from the spray gun, this switch, for instance in the event of only brief disturbances in the pressure source for the atomizing gas, can already cut-off the high-voltage generator when the supply of pressurized atomizing gas in the infeed line leading to the spray gun is still sufficient to ensure for operation of the spray gun until the disturbance at the pressure source has been overcome. On the other hand, if with the heretofore known installation according to the aforementioned British Pat. No. 1,273,064 the disturbance in the flow of the atomizing gas is caused by clogging at the atomizing or spray nozzle of the spray gun, then the prior art flow switch responds much too slowly, because between it and the spray gun there is present an appreciable length of a compressible air column. However, with the proposed spray gun of the invention such drawbacks are extensively overcome.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figures 1, 2:
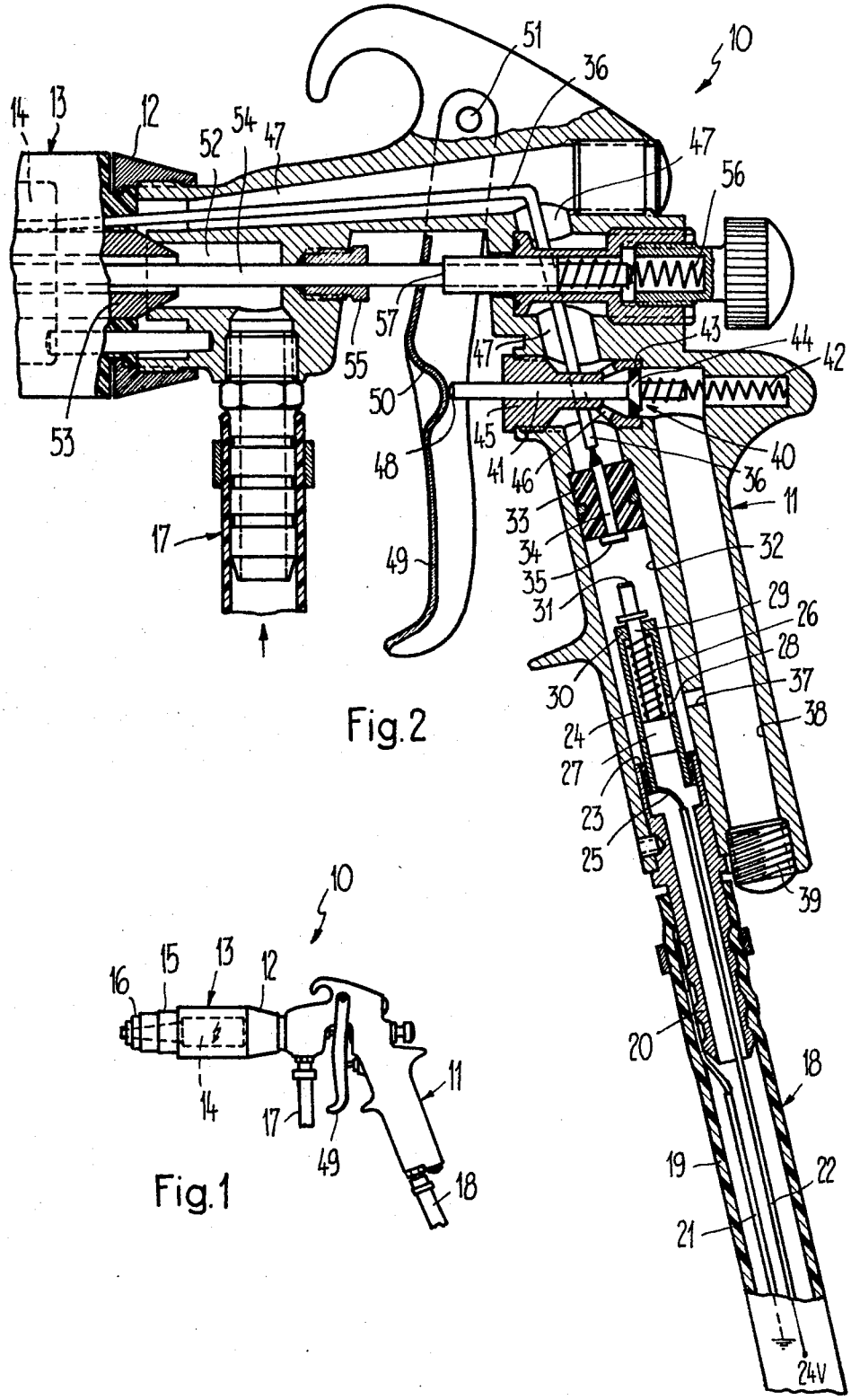
FIG. 1 is a side view of an electrostatic spray gun to which there are infed, on the one hand, a liquid coating material, and, on the other hand, atomizing air, both under pressure.
FIG. 2 is a sectional view through part of the spray gun of FIG. 1, the illustration being on an enlarged scale.

Describing now the drawings, the exemplary embodiment of spray gun 10 will be seen to comprise a handle portion or handgrip 11 and a barrel portion or barrel means 13 secured thereto by means of any suitable connection device, here shown as a screw cap or retaining nut 12. Within the barrel portion 13 there is mounted a high-voltage generator 14 having a low-voltage side, for instance a high-voltage cascade, which may be of the type disclosed in the previously mentioned Swiss Pat. No. 496,481, to which reference may be readily had and the disclosure of which is incorporated herein by reference. The barrel portion 13 terminates at an atomizing or spray nozzle 16 which is secured thereto by a screw cap or retaining nut 15 or equivalent structure in which there are incorporated not particularly illustrated charging electrodes, constituting structure which is well known in this technology. Obviously different arrangements of charging electrodes may be employed, one possibility being disclosed in the commonly assigned, copending U.S. application of Karl Buschor, Ser. No. 964,083, filed Nov. 27, 1978, now U.S. Pat. No. 4,196,465, to which reference may be readily had and the disclosure of which is likewise incorporated herein by reference.

As best seen by referring to FIG. 2, at the handle portion or handgrip 11 there are connected a pressure line or conduit 17 for the infeed of a coating material, typically for instance a lacquer, and a pressure line or conduit 18 for infeeding an atomizing gas, for instance compressed air. As likewise apparent from the illustration of FIG. 2, the pressure line or conduit 18, formed as a hose 19 and drawn onto a closure nipple 20 or equivalent structure anchored at the lower end of the handle portion 11, encloses two insulated lines or conductors 21 and 22. The line 21 serves as a ground line and is clamped at its end stripped of the electrical insulation, which end is located at the side of the spray gun, by means of the hose 19 at the outer surface of the connection or connecting nipple 20 which, like the handle portion 11, consists of any suitable electrically conducting material. At the inner end of the connection nipple 20 there merges therewith, by means of an insulating sleeve 23, the open end of a valve cylinder 24 formed of conductive material. Soldered or otherwise suitably fixed to such valve cylinder 24 is the insulation stripped end 25 of the line or conductor 24 carrying for instance a potential of 24 volts, depending upon the design of the high-voltage generator 14. A metallic valve piston 27 is displaceably mounted, against the action of a weak pressure or compression spring 26, within the valve cylinder 24. The valve piston 27, in the depicted rest position of FIG. 2, maintains closed a throughpass opening 28 having a comparatively small throughpass cross-sectional area and leading out of the valve cylinder 24. Attached to the valve piston 27 is a guide plunger or rod 29 which displaceably extends through the floor or base 30 of the valve cylinder 24. At its free end the valve plunger 29 carries a small contact plate 31. The valve cylinder 24 extends with play into a bore or compartment 32 formed at the handle portion 11. This bore 32 is sealingly closed at its upper end by a plug or stopper 33 formed of any suitable electrically insulating material. Extending through the plug or stopper 33 is a fixed contact pin 34. This contact pin 34 is likewise provided with a small contact plate 35 at its end confronting the plunger 29 and its contact plate 31, whereas its other end is soldered or otherwise suitably fixed to an insulated line or conductor 36 leading to the high-voltage generator 14. The parts or elements 24, 27, 29, 31 as well as 35 and 34 thus form a flow-actuated switch, or briefly termed a flow switch. On the other hand, the elements 24, 26, 27 and 28 form a differential pressure valve which is closed in the presence of pressure equalization. The mode of operation of both the flow switch and also the differential pressure valve will be explained more fully hereinafter.

The bore 32 in the handle portion 11 flow communicates by means of a throughpass opening or passage 37 having a small cross-sectional area with a further bore or compartment 38 formed in the handle portion 11. The lower end of the bore 38 is tightly closed by means of a threaded plug or stopper 39 or equivalent structure. At the upper end of this bore 38 there is arranged a manually-operated valve 40. This manually-operated or manually-actuatable valve 40 possesses a valve plate 44 which can be raised away from a stationary valve seat 43 against the action of a pressure or compression spring 42. This valve plate 44 is attached to a plunger or rod 41. The valve seat 43 is arranged at one end of a guide sleeve 45 which is threaded into the handle portion 11 and serving as a valve housing for the plunger or rod 41. Within this guide sleeve 45 there are formed throughpass openings or passageways 46 at the region connecting with the valve seat 43. These throughpass openings 46 open into a channel 47 for the atomizing or spray gas. Channel 47 is formed in the handle portion 11, contains the line 36 and leads to the barrel portion 13.

The plunger 41 bears by means of its end 48 protruding out of the guide sleeve 45 upon an inset portion or depression 50 formed at a trigger bracket or trigger 49. This trigger bracket 49 is hingedly mounted at its upper end by means of a pivot pin 51 or the like at the handle portion 11.

The pressure line 17 for the liquid coating material opens into a channel 52 at which there is connected a pipe or conduit 53 coaxially arranged in the barrel portion 13 and leading up to the region of the atomizing or spray nozzle 16. At the not particularly illustrated end of the pipe 53, located at the side of the nozzle 16, there is arranged a needle valve (not shown) whose needle portion extends by means of its needle shaft 54 through the pipe 53 and the channel 52, through a packing screw 55 or the like and the trigger bracket 49 back into the handle portion 11, and at this location is supported upon a pressure or compression spring 56 which strives to press the shaft 54 to the left of the showing of FIG. 2, and thus, to retain the non-illustrated needle valve located near the atomizing or spray nozzle 16, in its closed position. A shoulder 57 is formed at the needle shaft 54, by means of which the needle shaft 54 can be displaced towards the right of the illustration of FIG. 2, against the action of the pressure spring 56, by means of the trigger bracket 49, i.e., leaves the needle valve open, but only then when—as will be seen from FIG. 2—the plunger 41 has already shifted the valve 40 towards the right, that is to say, the valve 40 has been opened.

Having now had the benefit of the foregoing description of the electrostatic spray gun of the invention, its mode of operation will be considered hereinafter and is as follows: If the pressure line or conduit 18 has infed thereto atomizing or spray air under pressure, but the valve 40 is still not yet it its open condition, then initially the valve piston 27 is raised for a brief period of time, until by means of the throughpass openings 28 and 37 there is established a pressure equalization between the pressure prevailing in the line 18 and that in the bores 32 and 38. Thereafter, the pressure or compression spring 26 comes into action and forces the piston 27 back into its starting position.

As soon as the trigger bracket or what may be also termed the trigger lever 49 has been depressed, then initially the valve 40 is opened, the pressure which has built-up previously in the bores 32 and 38 discharges into the channel 47 and the pressure prevailing in the line 18 forces the piston 27 upwardly against the action of the spring 26. Consequently, on the one hand, the throughpass opening 28 is freed, and, on the other hand, the small contact plates 31 and 35 come into mutual contact with one another, so that the high-voltage generator 14 is turned-on. During the now prevailing airflow from the pressure line 18 through the throughpass openings or passages 28 and 37 into the bore 38 and from that location, by means of the valve 40 into the channel 47, there is formed by means of the relatively small throughpass opening 28 a pressure drop, i.e., a pressure gradient between the pressure impinging at the piston 27 and that prevailing externally of the valve cylinder 24. This pressure gradient is sufficient in order to maintain the piston 27 in its raised position, and thus, the contact plates 31 and 35 in mutually contacting relationship.

Now if the pressure in the line 18 drops or, however, if the airflow in the channel 47 is disturbed, for instance by clogging of the nozzle 16, then there is reduced the flow quantity and thus the flow rate through the opening 28. Consequently, also the pressure drop across such opening 28 becomes smaller and the piston 27 will be shifted, even if not completely, in the direction of its starting position, so that in any event the contact plates 31 and 35 are no longer in contact i.e., the high-voltage generator 14 is turned-off.

On the other hand, if the valve 40 is closed by releasing the trigger bracket or lever 49 then the piston 27 returns back into its starting position, as soon as there has been accomplished a pressure equalization to both sides or faces of such piston 27, i.e., the high-voltage generator 14 remains turned-on for a few fractions of a second, even if previously the infeed of coating material through the needle valve and thereafter the infeed of atomizing air through the valve 40 has been interrupted. This ensures that the electrical field emanating from the charging electrodes of the nozzle 16 remains intact for a brief amount of time, until the last particles, effluxing from the nozzle 16, have reached the article or object to be coated and which is grounded.

While there are shown and described present preferred embodiments of the invention, it is to be distinctly understood that the invention is not limited thereto, but may be otherwise variously embodied and practiced within the scope of the following claims.

Accordingly, what I claim is:

1. An electrostatic spray gun comprising:

gun means providing a gun portion and a handle portion;

a high-voltage generator having a low-voltage side mounted in said gun means;

switch means mounted in said gun means for turning-on and turning-off said high-voltage generator at its low-voltage side;

said gun means including structure defining a flow channel for an atomizing gas;

a pressure line for the infeed of the atomizing gas operatively connected with said flow channel;

a manually-operated closure valve means arranged in said flow channel;

said switch means being arranged in said flow channel and being structured as a flow switch;

said flow switch having a movable contact;

a differential pressure valve arranged in said flow channel;

said differential pressure valve having a closure portion;

said movable contact being coupled with said closure portion;

said atomizing gas moving in a predetermined direction through said flow channel; and said flow switch being arranged in front of said closure valve means, viewed in the flow direction of said atomizing gas.

2. The spray gun as defined in claim 1, wherein:

said differential pressure valve is arranged to be electrically insulated in said handle portion of said spray gun and simultaneously constitutes a component of said flow switch.

3. The spray gun as defined in claim 1, wherein:

said differential pressure valve comprises:

a valve cylinder having an open side connected with said pressure line;

a piston defining said closure portion displaceably mounted in said valve cylinder;

a pressure spring against which said piston is displaceable in said valve cylinder;

said gun means including a compartment defining part of said flow channel and arranged forwardly of said closure valve means;

said valve cylinder being provided with a throughpass opening flow communicating with said compartment; and said piston, when impinged with the atomizing gas from the pressure line, being displaced such that the throughpass opening is freed.

4. The spray gun as defined in claim 3, further including:

a line carrying a low-voltage with which there is electrically connected said valve cylinder;

said piston being provided with a piston plunger carrying said movable contact of said flow switch; and said piston electrically conductively contacting said valve cylinder.

5. An electrostatic spray gun comprising:

gun means providing a gun portion and a handle portion;

a high-voltage generator having a low-voltage side mounted in said gun means;

switch means mounted in said gun means for turning-on and turning-off said high-voltage generator at its low-voltage side;

said gun means including structure defining a flow channel for an atomizing gas;

a pressure line for the infeed of the atomizing gas operatively connected with said flow channel;

a manually-operated closure valve means arranged in said flow channel;

said switch means being arranged in said flow channel and being structured as a flow switch;

said flow switch having a movable contact;

a differential pressure valve arranged in said flow channel;

said differential pressure valve having a closure portion;

said movable contact being coupled with said closure portion;

said differential pressure valve being arranged to be electrically insulated in said handle portion of said spray gun and simultaneously constitutes a component of said flow switch;

said differential pressure valve comprising:

a valve cylinder having an open side connected with said pressure line;

a piston defining said closure portion displaceably mounted in said valve cylinder;

a pressure spring against which said piston is displaceable in said valve cylinder;

said gun means including a compartment defining part of said flow channel and arranged forwardly of said closure valve means;

said valve cylinder being provided with a throughpass opening flow communicating with said compartment; and said piston, when impinged with the atomizing gas from the pressure line, being displaced such that the throughpass opening is freed.

6. The spray gun as defined in claim 5, further including:

a line carrying a low-voltage with which there is electrically connected said valve cylinder;

said piston being provided with a piston plunger carrying said movable contact of said flow switch; and said piston electrically conductively contacting said valve cylinder.

* * * * *